US009863674B2

(12) United States Patent
Kuehl et al.

(10) Patent No.: US 9,863,674 B2
(45) Date of Patent: Jan. 9, 2018

(54) FIN-COIL DESIGN FOR DUAL SUCTION AIR CONDITIONING UNIT

(71) Applicant: Whirlpool Corporation, Benton Harbor, MI (US)

(72) Inventors: Steven Kuehl, Stevensville, MI (US); Nihat Cur, St. Joseph, MI (US); Guolian Wu, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 14/849,954

(22) Filed: Sep. 10, 2015

(65) Prior Publication Data

US 2015/0377529 A1 Dec. 31, 2015

Related U.S. Application Data

(63) Continuation of application No. 13/800,749, filed on Mar. 13, 2013, now Pat. No. 9,188,369.
(Continued)

(51) Int. Cl.
*F25B 39/02* (2006.01)
*F24F 3/14* (2006.01)
(Continued)

(52) U.S. Cl.
CPC ..... *F25B 39/028* (2013.01); *F24F 3/1405* (2013.01); *F25B 1/00* (2013.01);
(Continued)

(58) Field of Classification Search
CPC .. F24F 3/1405; F25B 1/10; F25B 5/00; F25B 6/02; F25B 7/00; F25B 39/028;
(Continued)

(56) References Cited

U.S. PATENT DOCUMENTS 2,328,472 A 8/1943 Lehane et al.
2,481,605 A 9/1949 Earle
(Continued)

FOREIGN PATENT DOCUMENTS

CN 101666526 A 3/2010
EP 0583905 A1 2/1994
(Continued)

OTHER PUBLICATIONS

International Application No. PCT/US2014026212, filed Mar. 13, 2014, Applicant: Whirlpool Corporation, International Search Report and Written Opinion re: Same, dated Jun. 26, 2014.
(Continued)

*Primary Examiner* — Mohammad M Ali
(74) *Attorney, Agent, or Firm* — Price Heneveld LLP

(57) ABSTRACT

An evaporator system that includes: a first evaporator coil at a first evaporator temperature and pressure; a second evaporator coil at a second evaporator temperature and pressure that is less than the first evaporator temperature and pressure where the first evaporator and second evaporator are configured to be thermally disjointed; and a plurality of thermally conductive spaced apart evaporator fins having a plurality of spaced apart thermal break portions positioned between the first evaporator coil and the second evaporator coil that thermally disjoin the first evaporator and the second evaporator.

18 Claims, 15 Drawing Sheets

Related U.S. Application Data

(60) Provisional application No. 61/622,840, filed on Apr. 11, 2012, provisional application No. 61/618,914, filed on Apr. 2, 2012.

(51) Int. Cl.

| | |
|---|---|
| ***F25B 1/00*** | (2006.01) |
| ***F25B 1/10*** | (2006.01) |
| ***F25B 5/00*** | (2006.01) |
| ***F25B 5/02*** | (2006.01) |
| ***F25B 6/02*** | (2006.01) |
| ***F25B 7/00*** | (2006.01) |
| ***F25B 41/04*** | (2006.01) |
| ***F28D 1/04*** | (2006.01) |
| ***F28F 1/32*** | (2006.01) |
| *F28D 21/00* | (2006.01) |

(52) U.S. Cl.

CPC ..... *F25B 1/10* (2013.01); *F25B 5/00* (2013.01); *F25B 5/02* (2013.01); *F25B 6/02* (2013.01); *F25B 7/00* (2013.01); *F25B 41/043* (2013.01); *F28D 1/0408* (2013.01); *F28F 1/32* (2013.01); *F25B 2341/0661* (2013.01); *F28D 2021/0071* (2013.01); *F28F 2215/02* (2013.01); *F28F 2215/04* (2013.01); *F28F 2270/00* (2013.01)

(58) Field of Classification Search

CPC .. F25B 41/043; F25B 5/02; F25B 1/00; F25B 2341/0661; F28F 2215/04; F28F 2270/00; F28F 2021/0071; F28F 2215/02; F28D 1/0408; F28D 2021/0071

USPC ..... 62/525

See application file for complete search history.

(56) References Cited

U.S. PATENT DOCUMENTS

| | | | | |
|---|---|---|---|---|
| 2,593,038 | A | 4/1952 | Lehane et al. | |
| 2,715,319 | A | 8/1955 | Graham | |
| 2,728,202 | A | 12/1955 | Grubb | |
| 2,976,698 | A | 3/1961 | Muffly | |
| 3,064,449 | A | 11/1962 | Rigney | |
| 3,577,742 | A | 5/1971 | Kocher | |
| 4,051,691 | A | 10/1977 | Dawkins | |
| 4,259,848 | A * | 4/1981 | Voigt | F25B 1/00 62/113 |
| 4,294,078 | A | 10/1981 | MacCracken | |
| 4,565,072 | A | 1/1986 | Fujiwara et al. | |
| 4,748,823 | A | 6/1988 | Asano et al. | |
| 4,873,837 | A | 10/1989 | Murray | |
| 4,938,032 | A | 7/1990 | Mudford | |
| 5,054,540 | A | 10/1991 | Carr | |
| 5,174,123 | A * | 12/1992 | Erickson | F25B 1/047 62/113 |
| 5,255,526 | A | 10/1993 | Fischer | |
| 5,333,470 | A | 8/1994 | Dinh | |
| 5,357,767 | A | 10/1994 | Roberts | |
| 5,682,752 | A | 11/1997 | Dean | |
| 5,765,393 | A | 6/1998 | Shlak et al. | |
| 5,878,810 | A | 3/1999 | Saito et al. | |
| 6,105,387 | A | 8/2000 | Hong et al. | |
| 6,116,048 | A * | 9/2000 | Hebert | F24F 1/0059 62/524 |
| 6,595,012 | B2 | 7/2003 | Rafalovich | |
| 6,715,305 | B2 | 4/2004 | Doi et al. | |
| 6,931,870 | B2 | 8/2005 | Kim et al. | |
| 7,028,764 | B2 | 4/2006 | Reagen | |
| 7,104,079 | B2 | 9/2006 | Kuwabara et al. | |
| 7,185,513 | B2 | 3/2007 | Bush et al. | |
| 7,219,505 | B2 | 5/2007 | Weber et al. | |
| 7,257,958 | B2 | 8/2007 | Bush et al. | |
| 7,363,772 | B2 | 4/2008 | Narayanamurthy | |
| 7,421,846 | B2 | 9/2008 | Narayanamurthy et al. | |
| 7,434,415 | B2 | 10/2008 | Knight et al. | |
| 7,441,558 | B2 | 10/2008 | Leifeer et al. | |
| 7,506,520 | B2 | 3/2009 | Oh | |
| 7,614,251 | B2 | 11/2009 | Choi et al. | |
| 7,631,515 | B2 | 12/2009 | Jacobi | |
| 7,793,515 | B2 | 9/2010 | Narayanamurthy | |
| 7,802,439 | B2 | 9/2010 | Valiya-Naduvath et al. | |
| 7,845,185 | B2 | 12/2010 | Knight et al. | |
| 7,954,336 | B2 | 6/2011 | Jacobi | |
| 2004/0226686 | A1 | 11/2004 | Maeda | |
| 2005/0000238 | A1 * | 1/2005 | Schmid | F25B 39/02 62/272 |
| 2005/0086965 | A1 | 4/2005 | Lalumiere et al. | |
| 2006/0130517 | A1 | 6/2006 | Merkys et al. | |
| 2006/0288713 | A1 | 12/2006 | Knight et al. | |
| 2007/0209383 | A1 | 9/2007 | Hutton | |
| 2008/0066489 | A1 | 3/2008 | Cieslik et al. | |
| 2008/0289354 | A1 | 11/2008 | Dudley et al. | |
| 2009/0205346 | A1 | 8/2009 | Major et al. | |
| 2010/0257880 | A1 | 10/2010 | Alden | |
| 2011/0000247 | A1 | 1/2011 | Narayanamurthy | |
| 2011/0036551 | A1 * | 2/2011 | Hancock | F28F 1/325 165/181 |
| 2011/0061410 | A1 | 3/2011 | Narayanamurthy | |
| 2011/0209490 | A1 * | 9/2011 | Mijanovic | B60H 1/00885 62/190 |

FOREIGN PATENT DOCUMENTS

| | | | |
|---|---|---|---|
| JP | S58108394 | A | 6/1983 |
| JP | H02213694 | A | 8/1990 |
| JP | 10267359 | A | 10/1998 |
| JP | 2001074325 | A | 3/2001 |
| JP | 2002107027 | A | 4/2002 |
| JP | 2005214483 | A | 8/2005 |
| JP | 2005214489 | A | 8/2005 |
| JP | 2005257247 | A | 9/2005 |
| JP | 2006090288 | A | 4/2006 |
| SU | 92890 | A | 11/1951 |
| SU | 1409832 | A1 | 7/1988 |
| WO | 0133147 | A1 | 5/2001 |

OTHER PUBLICATIONS

European Patent Office, "European Search Report," issued in connection with European Patent Application No. 14772772.1, dated Nov. 28, 2016, 6 pages.

* cited by examiner

FIN-COIL DESIGN FOR DUAL SUCTION AIR CONDITIONING UNIT

CROSS-REFERENCE TO RELATED APPLICATIONS

This application is a continuation application of U.S. patent application Ser. No. 13/800,749 entitled FIN-COIL DESIGN FOR DUAL SUCTION AIR CONDITIONING UNIT, filed on Mar. 13, 2013, now U.S. Pat. No. 9,188,369 issued on Nov. 17, 2015, which claims priority to and the benefit of U.S. Provisional Application Ser. No. 61/622,840, filed on Apr. 11, 2012, entitled LOW ENERGY AIR CONDITIONING WITH TRUE COMFORT CONTROL. U.S. patent application Ser. No. 13/800,479 also claims priority to and the benefit of U.S. Provisional Application Ser. No. 61/618,914, filed on Apr. 2, 2012, entitled ENERGY EFFICIENT HOME APPLIANCES, the entire disclosure of which is hereby incorporated by reference.

BACKGROUND

Air conditioning systems for building structures, dwellings or individual rooms have historically utilized a standard vapor compression cooling system to cool an interior volume of a building structure 2 containing walls 4 and/or ceilings 6. A traditional home or building air conditioning system is shown schematically in FIG. 1. As shown there, the air conditioning system 10 typically includes an exterior positioned machine compartment housing 12 mounted on a base platform 14 where the housing 12 contains a single outlet, single input compressor 16, a condenser 18, and a thermal expansion device 20. These traditional systems also typically include a fan 22 associated with condenser 18, the size of which depends on various factors. For whole dwelling/building systems, which the compressor and condenser must provide higher cooling capacity, the systems are sized to match thermal load and are typically larger. Coolant fluid conduits 24 deliver coolant through the vapor compression system and deliver coolant fluid that has passed through the compressor, the condenser and the throttling device to a single evaporator 26 that operates at a single evaporator pressure located within an air passageway 28 within the building structure 2. The air passageway could be an air duct, air vents of a room air conditioning system or a portion of the building's interior heating, ventilation and air conditioning machine compartment located within the building structure 2. Typically, the evaporator 26 is positioned within the building's heating ventilation and air conditioning machine compartment. The air passageway 28 typically has an air circulation fan 30 associated with it to distribute air through the building structure 2 or into a portion of the building structure. The air circulation fan delivers air across the single evaporator where it is cooled and the cooled air 32 distributed to the volume of interior air to be cooled. Air is returned to the evaporator as shown by reference numeral 34. Typically, a building structure may have an exterior air inlet/path that allows exterior air to enter, typically passively enter, the building structure from outside the building structure either directly into the air passageway 28 or into the building structure air where the exterior air is then circulated within the building structure.

While this system does cool the building structure interior it typically does not allow for regulation of both the temperature and humidity of the interior of a building structure. When this traditional air conditioner is used, humidity is removed based upon the temperature of the single evaporator. A person within the interior volume of the building structure might want more or less humidity removed from the air within the building structure than what is allowed by such single evaporator systems.

BRIEF SUMMARY OF THE INVENTION

An aspect of the present invention includes an evaporator system that includes: a first evaporator coil at a first evaporator temperature and pressure; a second evaporator coil at a second evaporator temperature and pressure that is less than the first evaporator temperature and pressure where the first evaporator and second evaporator are configured to be thermally disjointed; and a plurality of thermally conductive spaced apart evaporator fins having a plurality of spaced apart thermal break portions positioned between the first evaporator coil and the second evaporator coil that thermally disjoin the first evaporator and the second evaporator.

Yet another aspect of the present invention includes an evaporator system that includes: a first evaporator coil at a first evaporator temperature and pressure; a second evaporator coil at a second evaporator temperature and pressure that is less than the first evaporator temperature and pressure where the first evaporator and second evaporator are configured to be thermally disjointed wherein the first evaporator and the second evaporator are disjointed by a configuration chosen from the group consisting of: a plurality of the same thermally conductive spaced apart evaporator fins a plurality of spaced apart thermal break portions are positioned between the first evaporator coil and the second evaporator coil; and a first set of evaporator fins thermally connected with the first evaporator coil and a second, physically separated from the first set, set of evaporator fins thermally connected with the second evaporator wherein the first evaporator fin set comprises individual fins spaced apart at a greater distance from one another than the fins of the second set of evaporator fins.

Another aspect of the present invention is generally directed toward an evaporator system that includes: a first evaporator coil at a first evaporator temperature and pressure; a second evaporator coil at a second evaporator temperature and pressure that is less than the first evaporator temperature and pressure where the first evaporator and second evaporator are configured to be thermally disjointed; and a first set of evaporator fins thermally connected with the first evaporator coil and a second, physically separated from the first set, set of evaporator fins thermally connected with the second evaporator wherein the first evaporator fin set comprises individual fins spaced apart at a greater distance from one another than the fins of the second set of evaporator fins.

These and other features, advantages, and objects of the present invention will be further understood and appreciated by those skilled in the art by reference to the following specification, claims, and appended drawings.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings, certain embodiment(s) which are presently preferred. It should be understood, however, that the invention is not limited to the precise arrangements and instrumentalities shown. Drawings are not necessarily to scale, but relative special relationships are shown and the drawings may be to scale especially where indicated. As such, in the description or as would be apparent to those skilled in the art certain features of the invention may be exaggerated in scale or shown in schematic form in the interest of clarity and conciseness.

DETAILED DESCRIPTION

Before the subject invention is described further, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

Where a range of values is provided, it is understood that each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

In this specification and the appended claims, the singular forms "a," "an" and "the" include plural reference unless the context clearly dictates otherwise.

The present invention is generally directed toward improved, more efficient air conditioning systems 110 for building structures 2. The air conditioning systems 110 relate to building structure air conditioning systems 110 that treat the air within all or a portion of the interior of a building structure. The systems discussed herein may be employed as whole building treatment systems, one room air conditioning systems, such as often employed by hotels, and all systems sized in-between. Conceivably, the systems could be used to treat only a portion of a single room. Essentially, the systems may be scaled as desired to work to treat whatever volume of internal space within a building structure as may be desired.

Figure 2:
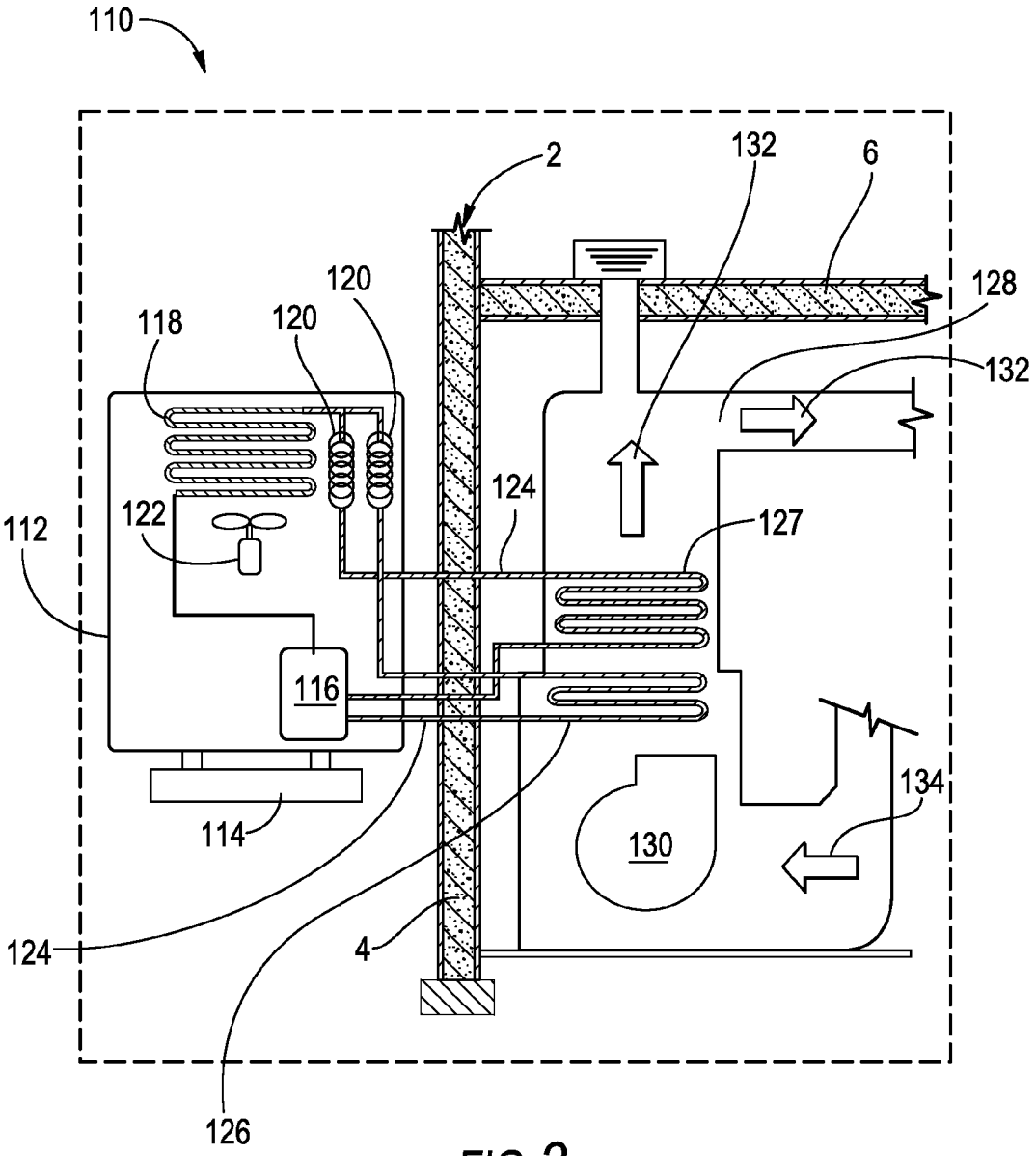
FIG. 2 is a schematic view of an air conditioning system for a building structure according to an aspect of the present invention employing a dual suction compressor and two evaporators operating at two different evaporating temperatures.
Figure 9:
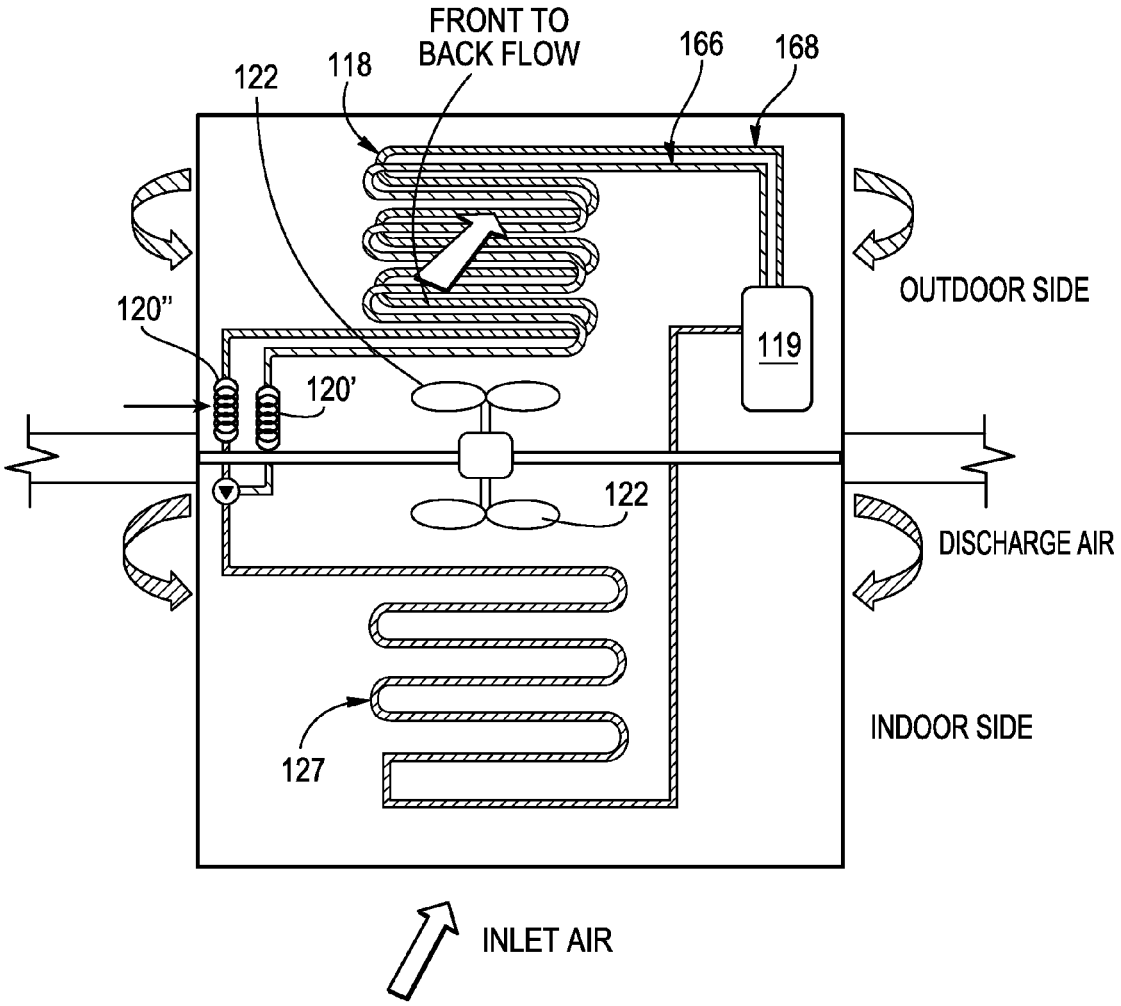
FIG. 9 is a schematic view of a dual discharge compressor containing air conditioning system of the type described in the thermodynamic cycle of FIG. 4*b* according to an aspect of the present invention.

As shown in FIG. 2, air conditioning systems 110 according to various aspects of the present invention for building structures or individual rooms utilize a vapor compression cooling system to cool an interior volume of a building structure 2 that employs a dual suction compressor 116 (FIG. 2), a dual suction-dual discharge compressor 117 (FIG. 10) or a dual discharge compressor 119 (FIG. 9). As shown in FIG. 2, the air conditioning system 110 typically includes an exterior positioned machine compartment housing 112 mounted on a base platform 114 where the housing 112 contains a dual suction compressor 116, a condenser 118, and a number of thermal expansion device 120 that typically matches the number of evaporators of the system. The air conditioning systems 110 of the present invention also typically include one or more fan 122 associated with condenser 118, the size and number of which depends on various factors. For whole building (home) systems that require more cooling capacity, the compressor and condenser must provide the higher cooling capacity, the fan(s) are larger and/or move air at a faster rate to cool the condenser adequately.

Coolant fluid conduits 124 deliver coolant through the vapor compression system and deliver coolant fluid that has passed through the compressor 116, the condenser 118 and the throttling device 120 to a plurality of evaporators 126, 127 (two are shown, but more than two could conceivably be employed and even greater efficiencies obtained) that operate within an air passageway 128 within the building structure 2. The air passageway could be an air duct, air vents of a room air conditioning system or a portion of the building's interior heating, ventilation and air conditioning machine compartment located within the building structure 2. Typically, the evaporators 126 and 127 are positioned proximate the building's heating ventilation and air conditioning machine compartment or within a portion of it. The air passageway 128 typically has an air circulation fan 130 associated with it to distribute air through the building structure 2 or into a portion of the building structure when the air conditioning system 110 treats a single room or an area smaller than an entire interior volume of a building structure. The air circulation fan delivers air across the evaporators 126, 127 where the air is cooled at two different evaporator temperatures and the cooled air 132 is distributed to the volume of interior air to be cooled within the building structure. Air is returned to the evaporator as shown by reference numeral 134. Typically, a building structure may have an exterior air inlet/path that allows exterior air to enter, typically passively enter, the building structure from outside the building structure either directly into the air passageway 128 or into the building structure air where the exterior air is then circulated within the building structure.

Figure 3:
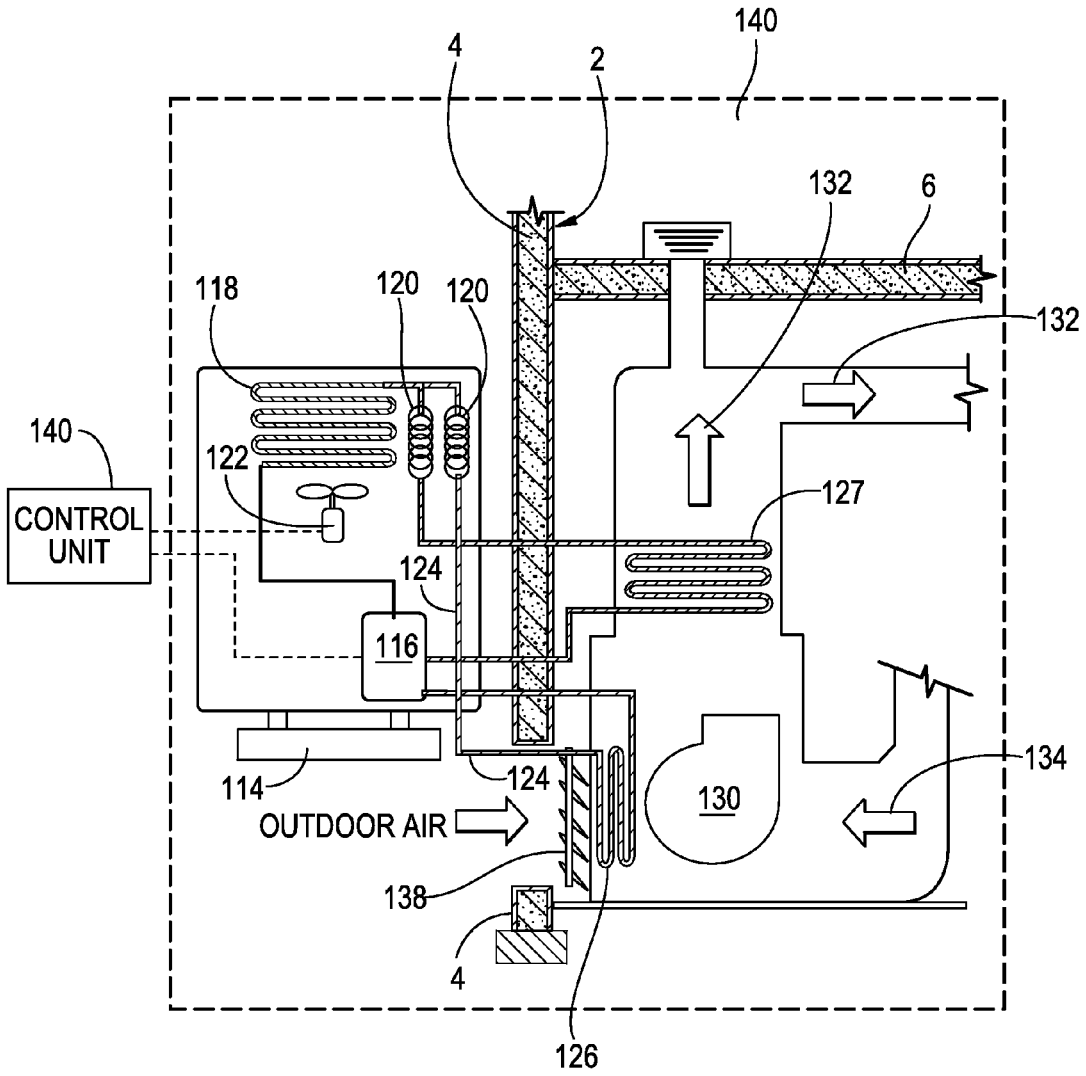
FIG. 3 is a schematic view of an air conditioning system for a building structure according to an aspect of the present invention employing a dual suction compressor and two evaporators operating at two different evaporating temperatures with one evaporator treating air taken in from the outdoor air and thereafter into the air passageway of the air conditioning system.

FIG. 3 shows a similar system to FIG. 2; however, the evaporator 126, which is the higher temperature evaporator as discussed more herein, conditions air from outside and allows for greater quantities of external (fresh) air to enter the building structure thereby improving the air quality of the air inside the building structure such as a home. As discussed in the Environmental Protection Agency's publication entitled "*The Inside Story: A Guide to Indoor Air Quality,*" outdoor air enters and leaves a house by: infiltration, natural ventilation, and mechanical ventilation. Infiltration describes outdoor air flows into the house through openings, joints, and cracks in walls, floors, and ceilings, and around windows and doors. Air moves through natural ventilation through opened windows and doors. Infiltration and natural ventilation is primarily caused by air temperature differences between indoors and outdoors and by wind. A number of mechanical ventilation devices exist to allow more outdoor air inside such as outdoor-vented fans that intermittently remove air from a single room, such as bathrooms and kitchens, and air handling systems that use fans and duct work to continuously remove indoor air and distribute filtered and conditioned outdoor air to strategic points throughout the house. The rate at which outdoor air replaces indoor air is the air exchange rate. When there is little infiltration, natural ventilation, or mechanical ventilation, the air exchange rate is low and indoor pollutant levels can increase. The present invention significantly increases the air exchange rate when the system of FIG. 3 is employed allowing for direct intake of outdoor air into the air conditioning system. Typically, the intake is fluidly coupled to, more typically proximate, a suction side of an air moving device such as a fan. For example, as shown in FIG. 3, the intake is fluidly coupled and proximate the air circulation fan 130, which draws.

The air conditioning system allows for the pretreatment of the outdoor air by the higher temperature evaporator 126. The higher temperature evaporator 126 is typically positioned just inside the building structure proximate one or more vents 138, which can be automatically or manually opened or closed. Instead of venting, louvers or other air closing mechanisms might be employed instead or in addition to the venting. In this manner the air conditioning system regulates and controls the volume of fresh, exterior air supplied to the system and thereby to the interior of the building structure. The addition of more fresh, exterior air from outside the building structure helps improve indoor air quality. The system is typically designed to strike a balance between the amount of fresh air and the energy efficiency. Due to the increased energy efficiency of the present invention, for the same amount of energy, the system can introduce fresh air from outside the building structure and therefore improve indoor air quality. Alternatively, energy efficiency may be further enhanced with less fresh, exterior air supplied to the system.

In the context of the present invention, a control unit 140 may be in signal communication with each of the components of the air conditioning systems of the present invention to dynamically adjust various elements of the system, including the compressor cooling capacity, to maximize energy efficiency. The control unit 140 may optionally receive one or more signals or other input from a user input such as the desired temperature for a given building structure interior volume or, for example, temperature sensors within a building structure or input from the compressor regarding the cooling capacity being supplied by the compressor. The control unit 140, which might be a computer system or processor such as a microprocessor, for example, is typically configured to dynamically adjust the functions of the various types (dual suction, dual suction-dual discharge, and dual discharge) compressors of the present invention, including, in the case of FIGS. 2-3, the functioning of the switching mechanism of the dual suction compressor, based upon one or more or all of these inputs to create the most efficient system possible. The control unit 140 also may control the one or more vents 138 between an open and closed position and any position there between and may also regulate the total cooling capacity being supplied by the compressor when the compressor is a variable capacity compressor such as a linear compressor or an oil-less, orientation flexible linear compressor. However, the application more likely will utilize a reciprocating compressor or a scroll compressor, which can be either single or variable capacity. It is also possible to further improve the efficiency of the system by also regulating and varying appropriately the fan(s) and/or compressor cooling capacity modulation through, for example, compressor speed or stroke length in the case of a linear compressor.

Figure 4A:
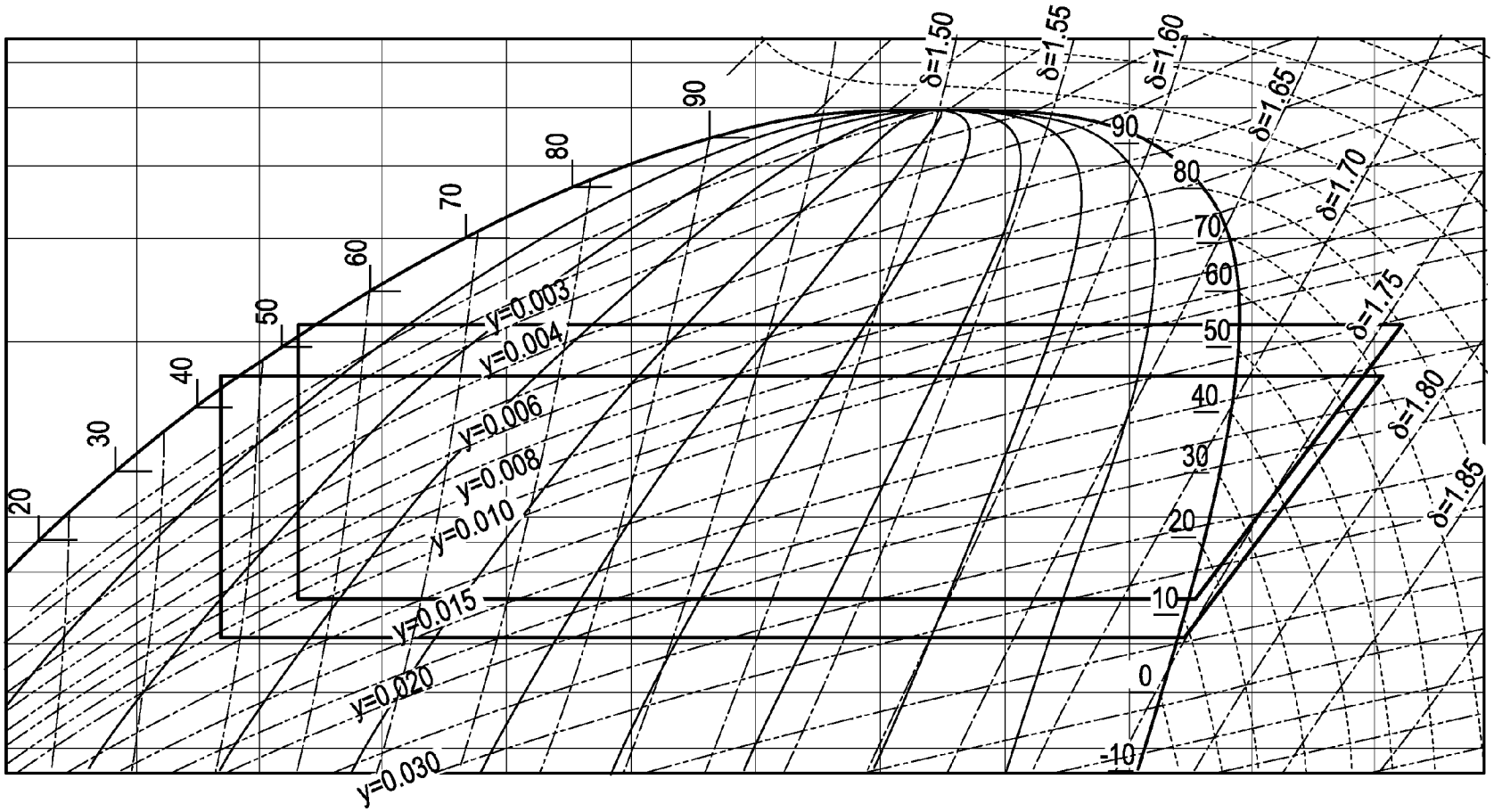
FIG. 4*a* is a thermodynamic cycle of a dual suction and dual discharge compressor containing air treatment system that may be utilized in connection methods of improving efficiency of the air conditioning system according to an aspect of the present invention.

The present invention includes the use of multiple (dual) evaporator systems that employ a switching mechanism for return of coolant to the compressor. The switching mechanism allows the system to better match total thermal loads with the cooling capacities provided by the compressor. Generally speaking, the system gains efficiency by employing the switching mechanism, which allows rapid suction port switching, typically on the order of a fraction of a second. The switching mechanism can be switched at a fast pace, typically about 30 seconds or less or exactly 30 seconds or less, more typically about 0.5 seconds or less or exactly 0.5 seconds or less, and most typically about 10 milliseconds or less or exactly 10 milliseconds or less (or any time interval from about 30 seconds or less). As a result, the system rapidly switches between a lower temperature evaporator 127 cooling operation mode and a higher temperature evaporator 126 cooling operation mode. The compressor 112 may be a variable capacity compressor, such as a linear compressor, in particular an oil-less linear compressor, which is an orientation flexible compressor (i.e., it operates in any orientation not just a standard upright position, but also a vertical position and an inverted position, for example). The compressor is typically a dual suction compressor (See FIG. 5) or a single suction compressor (See FIGS. 6-7) with an external switching mechanism. When the compressor is a single suction compressor (FIG. 6-7), it typically provides non-simultaneous dual suction from the coolant fluid conduits 144 from the higher temperature air treatment evaporator and the lower temperature air treatment evaporator As shown in FIGS. 2-3, one aspect of the present invention utilizes a sequential, dual evaporator refrigeration system as the air conditioning system 110. The dual evaporator refrigeration system shown in FIG. 2 employs a lower temperature evaporator 127 and a higher temperature evaporator 126 are each fed by coolant fluid conduits 124 engaged to two separate expansion devices 120. Due to the evaporating pressure differences cooling the air at different operating temperatures, the evaporators do not continuously feed refrigerant flow to the suction lines simultaneously and thus are activated as cooling is needed at different levels and to regulate the humidity of the air. In this sense, a major advantage of the dual (or multiple) evaporator system is that the higher temperature evaporator runs at a higher temperature than the lower temperature evaporator, thereby increasing the overall coefficient of performance (See FIG. 4*a* for a dual suction/dual discharge compressor and FIG. 4*b* for dual discharge compressor).

Because the higher temperature evaporator coolant circuit operates at a much higher temperature than the lower temperature evaporator coolant circuit operates, the thermodynamic efficiency of the cooling system is improved. For example, assuming that the evaporating temperature is 7.2° C. and the condensing temperature is 54.4° C. and the isentropic efficiency (including motor efficiency) is 0.6, the COP of the cooling system would be estimated at 2.69. In a dual suction compressor system, assuming the coolant circuits are 50% and 50% in terms of heat transfer area and assuming the first circuit operates at an evaporating temperature of 17° C., the first circuit COP is 3.66. The overall COP of the system employing a dual suction system would be (0.5*3.66)+(2.69*0.5)=3.175. This amounts to about an 18% improvement in system COP compared to the conventional single suction compressor system. The analysis assumes that the condensing temperature is the same for both circuits. In fact, the condensing temperature will be higher for dual suction compressor system so the actual COP will be lower than 18%, but significant COP are achieved using such dual suction systems. The overall coefficient of performance is a weighted average of the coefficient of performance of the higher temperature evaporator containing circuit and the lower temperature as follows:

$$COP_{Total}==X*COP_{HTE}+(1-X)*COP_{LTE}$$

"X" is the ratio of high temperature evaporator cooling rate to the total cooling rate the system provides.

As discussed above, the first evaporator may treat the initial air either within the air passageway directly in line with the second evaporator (FIG. 2) or it may be positioned to pre-cool and dehumidify air received from outside the building structure (FIG. 3). The lower temperature evaporator 127, which operates at a lower pressure (colder temperature), may be used to pull more moisture out of the air and thereby regulate humidity in an interior volume of the building structure. Similarly, if the higher temperature evaporator is used more to cool the interior air of the building structure, the humidity level would be higher. There would be less latent cooling and thus less moisture removed from the air.

While the use of two evaporators is the typical configuration of this embodiment of the present invention, the configuration could conceivably utilize, three, four, or more evaporators positioned at various outdoor air intakes or locations within the air passageways. So long as the lower temperature evaporator circuit is at a lower temperature than the higher temperature evaporator circuit and the average temperature of the two evaporators is warmer than the average temperatures of the air passing through a single evaporator, efficiencies are gained.

An aspect of the present invention includes increasing the efficiency of the air conditioning system by rapidly switching between the lower temperature evaporator operation mode and a higher temperature evaporator operation mode. Where T1 is the opening time of the high pressure suction port; T2 is the opening time of the low pressure suction port; T_on is the compressor on time; and the T_off is the compressor off time, by varying T1, T2, T_on and T_off, it is possible to most efficiently meet the total thermal load requirements of the building structure interior volume being cooled with the cooling capacity (fixed or variable) provided by the compressor to thereby increase the overall coefficient of performance of the coolant system of the air conditioning system. It is also possible to further improve the efficiency of the system by also regulating and varying appropriately the fan(s) and/or compressor cooling capacity modulation through, for example, compressor speed or stroke length in the case of a linear compressor.

Figure 5:
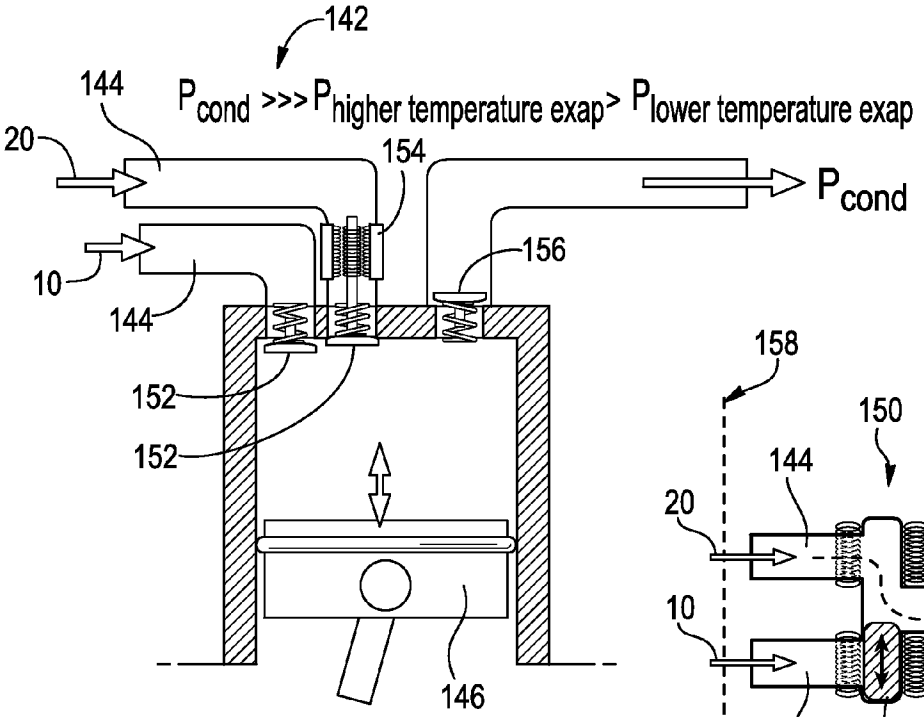
FIG. 5 shows a compressor according to an aspect of the present invention showing dual suction.
Figure 6:
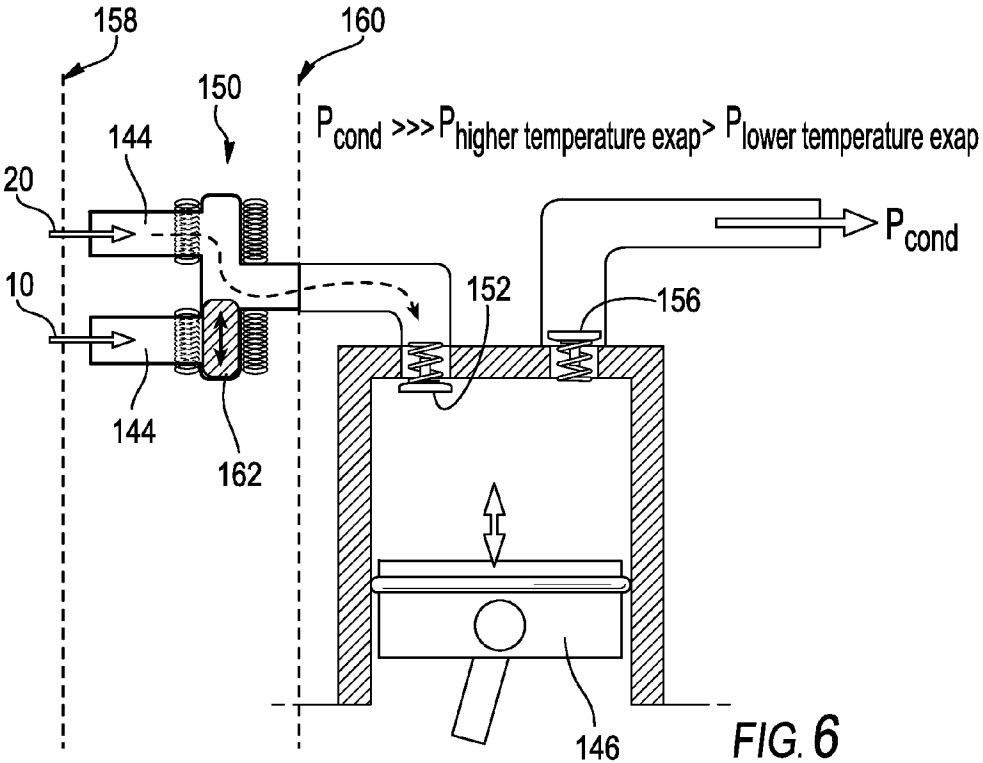
FIG. 6 shows another embodiment of a single suction compressor employing a three-way valve either inside the compressor or outside the compressor housing (the housing shown by the dashed line) according to an aspect of the present invention enabling dual suction.
Figure 7:
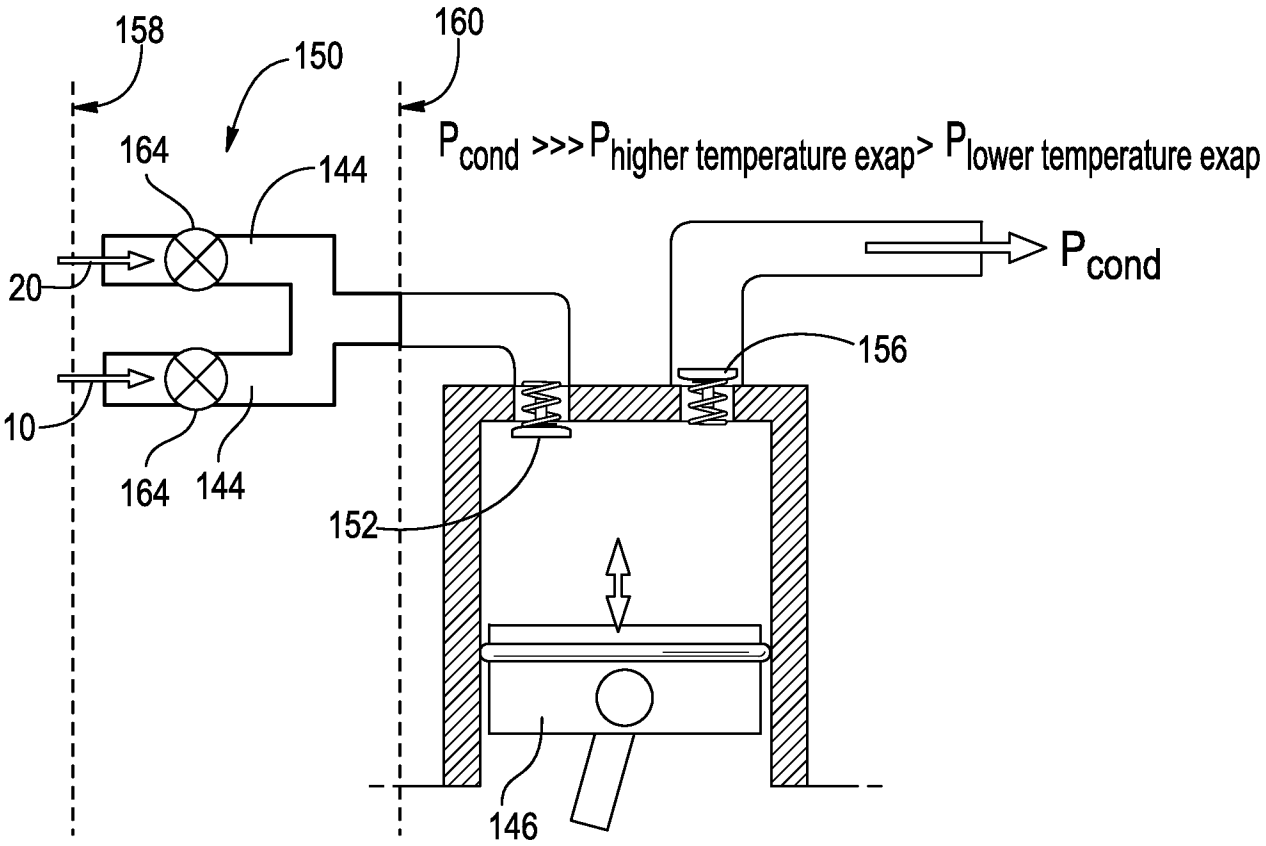
FIG. 7 shows another embodiment of a compressor employing two solenoid valves on either inside the compressor or outside the compressor housing (the housing shown by the dashed line) according to an aspect on the present invention showing dual suction.

The compressor 116 may be a standard reciprocating or rotary compressor, a variable capacity compressor, including but not limited to a linear compressor, or a multiple intake compressor system (see FIGS. 5-7). When a standard reciprocating or rotary compressor with a single suction port is used the system further includes a switching mechanism 150 containing compressor system (see FIG. 6-7). As shown in FIG. 5, a dual suction compressor 116 according to an aspect of the present invention may utilize a valving system 142 incorporated into the compressor that contains two coolant fluid intake streams 144, one from the lower temperature evaporator and one from the higher temperature evaporator. When a linear compressor, which can be on oil-less linear compressor, is utilized, the linear compressor has a variable capacity modulation, which is typically larger than a 3 to 1 modulation capacity typical with a variable capacity reciprocating compressor. The modulation low end is limited by lubrication and modulation scheme.

FIGS. 6-7 generally show a switching mechanism 150 according to the present invention. FIG. 5, as discussed above, shows a valving system 142 that is used in dual suction port compressor systems. FIGS. 6 and 7 show a switching mechanism 150 that can be positioned either external or within a single suction port system that allows for two or more fluid intake conduits 144 to feed into the single suction port. A compressor piston 146 is utilized in each dual coolant fluid intake systems shown in FIGS. 5-7. In the case of FIG. 5, coolant fluid is received into the piston chamber 148 from the lower temperature evaporator and higher temperature evaporator fluid conduits when the piston 146 is drawn backward, the piston chamber intake valves 152 are both opened, or, when the solenoid switch 154 is activated, only coolant fluid from the lower temperature evaporator fluid conduit is drawn in, and the piston chamber intake valve 152 associated with the intake from the higher temperature evaporator fluid conduit is not actuated, but retained in a closed position. When the piston stroke is actuated toward the piston chamber valves, piston chamber outlet valve 156 is opened by fluid pressure to allow coolant fluid to pass to the condenser 118.

Alternatively, depending on which circuit will be open more frequently, when the higher temperature evaporator circuit is opened less frequently such as will typically be the case in the case of the system of FIG. 3, the valve 152 to the higher temperature evaporator circuit might be biased, typically by a spring, to a normally closed position and the solenoid would bias the valve to the open position when cooling is requested by the system. In this manner still further energy is saved. Additionally, the solenoid valve could be of the latching type that requires only a pulse (typically on the order of 100-1500 milliseconds) of energy to actuate.

An alternative embodiment is shown in FIGS. 6-7, which show a single piston chamber intake valve 152, which is fed from a switching mechanism 150. The switching system 150 as shown by lines 158 and 160, which represent the housing of the compressor, may be within the housing of the compressor when the housing is at position 158 relative to the switching mechanism 150 and outside of the housing when the housing is in position 160 relative to the switching mechanism 150. The position of the housing (represented by reference numerals 158 and 160) in FIGS. 6 and 7 are simply meant to display that the switching mechanism 150 may be outside of the housing or within the housing of the single suction compressor. The switching mechanism 150 may employ a magnetically actuated solenoid system where obstruction 162 is actuated between a first position (shown in FIG. 6) allowing refrigerant coolant to flow from the (higher pressure/temperature) evaporator and a second position (not shown) where the obstruction 162 is positioned to block fluid paths from the higher pressure/temperature evaporator and allow refrigerant to flow from the (lower pressure/temperature) evaporator. The alternative embodiment shown in FIG. 7 shows two solenoid valves 164 that may be controlled by the control unit 140 to be in an open or closed position. The solenoid valves 164 alternate coolant flows to the compressor between coolant from the first fluid conduit and the second fluid conduit. The solenoid valves are typically only opened one at a time. In the embodiments of FIGS. 5-7 of the compressor systems, the pressure of the coolant fluid leaving the compressor for the condenser is significantly higher than the pressure of the coolant received from the higher temperature evaporator or the lower temperature evaporator, but the pressure of the coolant received from the higher temperature evaporator fluid conduit is greater than the coolant received from the lower temperature evaporator fluid conduit. This, as discussed above, allows for greater efficiencies of the overall coolant system.

Figure 4B:
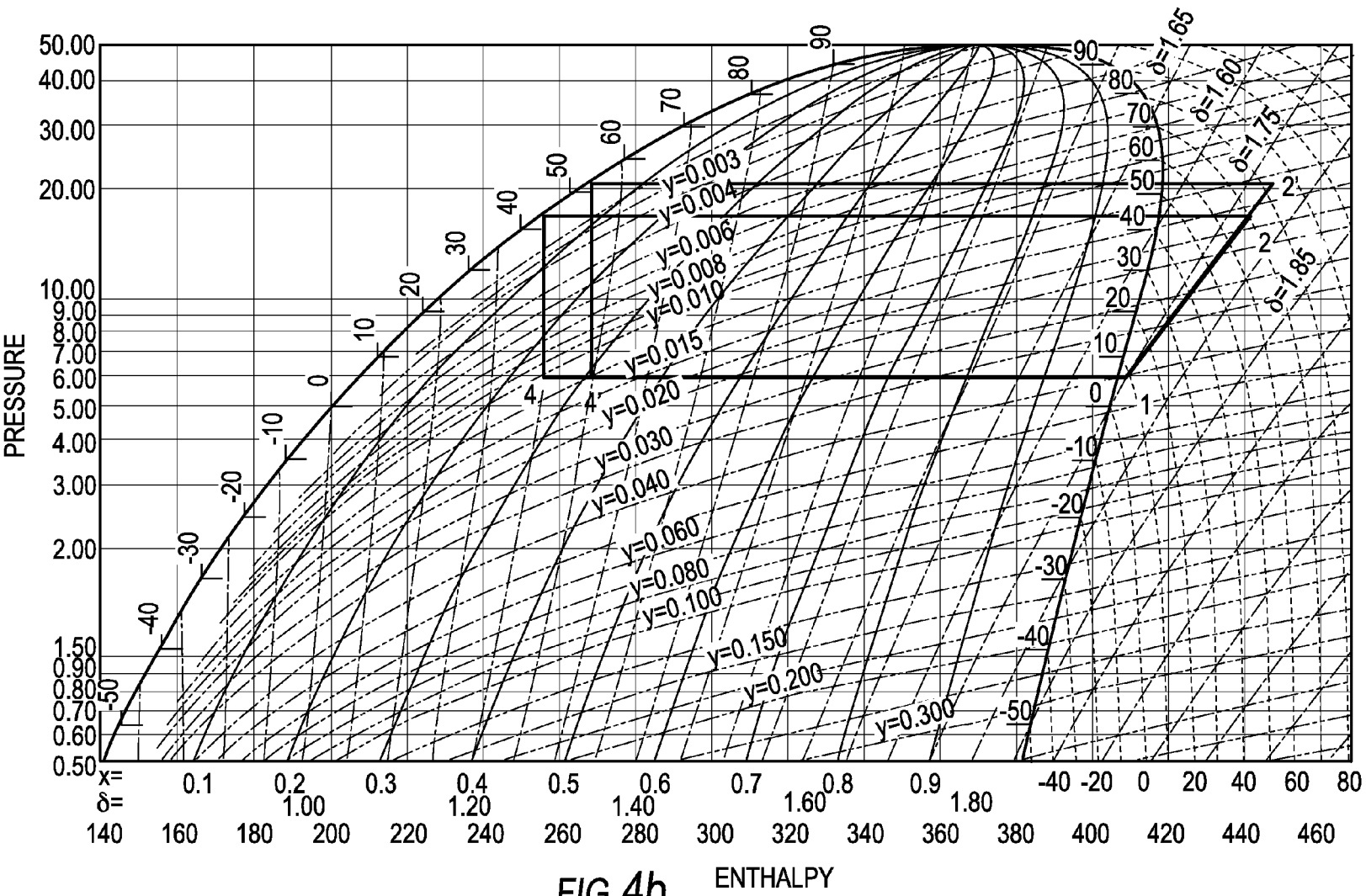
FIG. 4*b* is a thermodynamic cycle of a dual discharge compressor containing air treatment system that may be utilized in connection methods of improving efficiency of the air conditioning system according to an aspect of the present invention.
Figure 10:
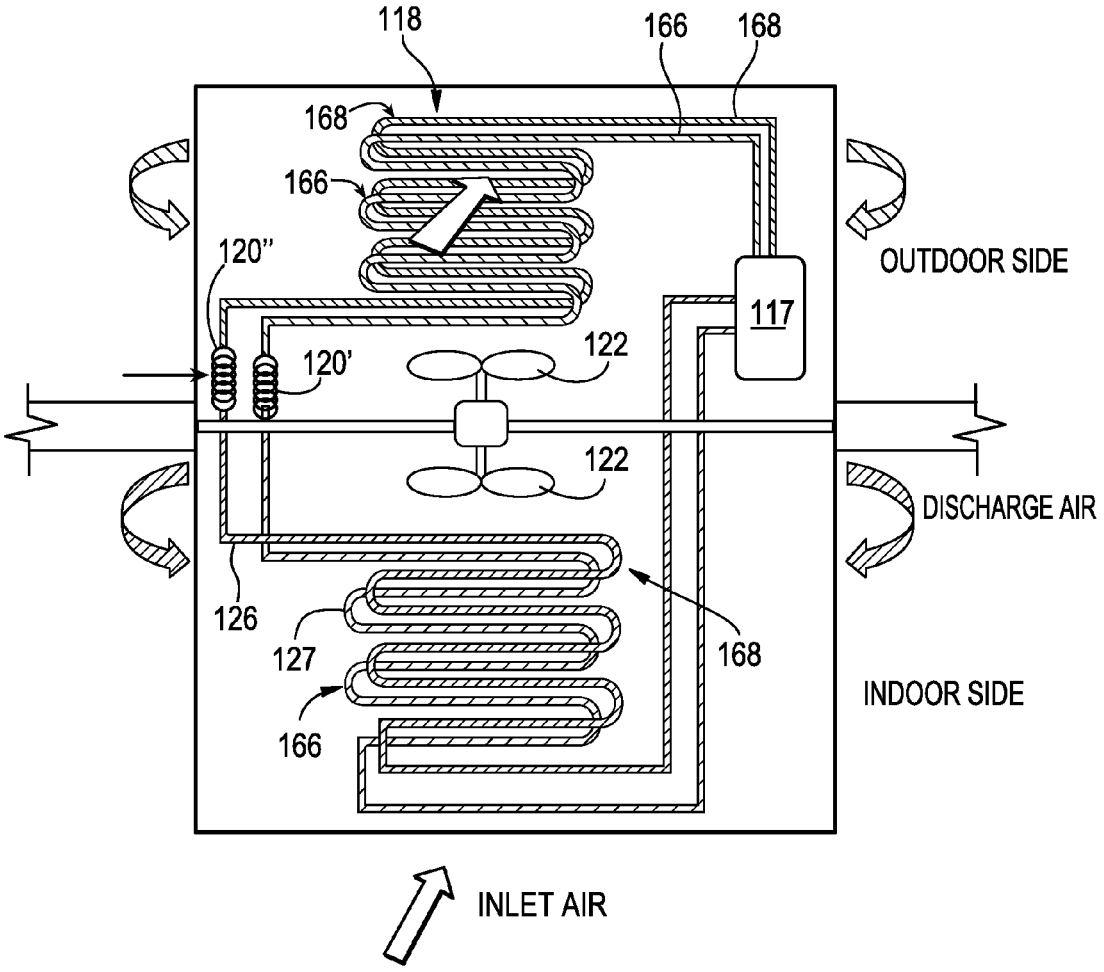
FIG. 10 is a schematic view of a dual suction and dual discharge compressor containing air conditioning system of the type described in the thermodynamic cycle of FIG. 4*a* according to an aspect of the present invention.

As shown in FIGS. 9 and 10, still further efficiencies can be gained on the air conditioning systems by using a multi/dual discharge compressor that is either a single suction (see FIG. 9) or a multi (dual-) suction compressor (see FIG. 10). In the case of dual discharge compressors, the dual discharge coolant fluid conduits typically independently feed separate thermal expansion devices 120', 120" after passing through the condenser 118. The refrigerant flows from the first circuit 166 of the condenser to the evaporator 127 via a less restrictive thermal expansion device 120' and from the second circuit 168 of the condenser to the evaporator 127 via a more restrictive thermal expansion device 120" than the thermal expansion device 120'. The dual discharge compressor 117, 119 rapidly switches between the two discharge ports. The frequency of the switching and the duration of operation of each port can be controlled by the control unit 140 to match the heat load requirement of each circuit of the condenser. Since the first circuit operates at a lower condensing temperature, the thermodynamic efficiency of the cooling system is improved as shown in FIG. 4*b*.

Figure 8B:
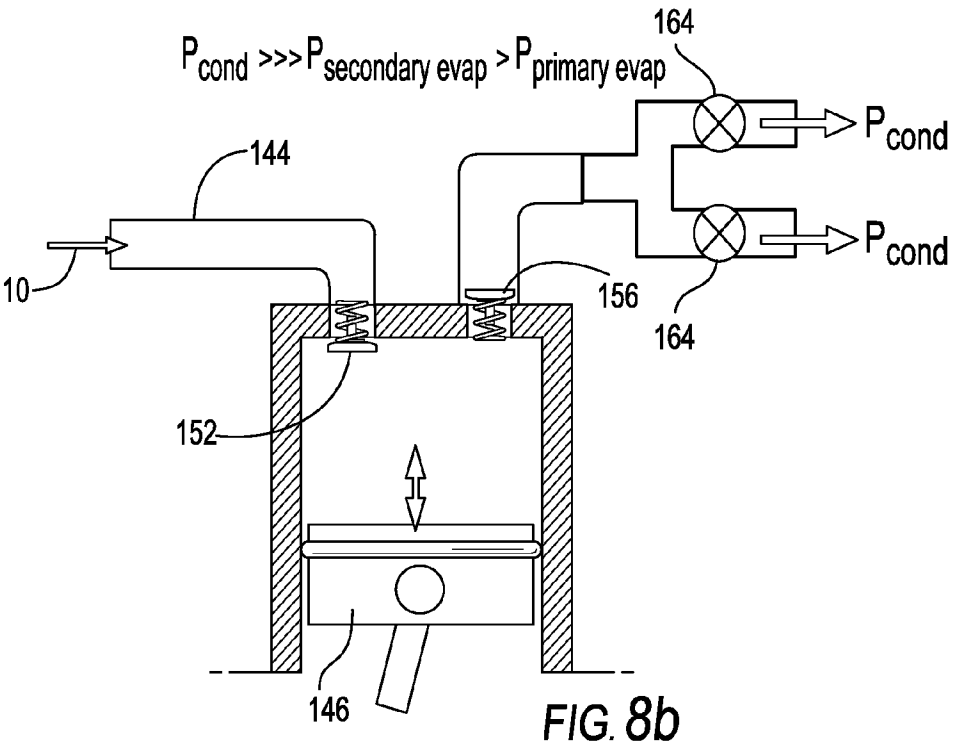
FIG. 8*b* is a schematic view of a single discharge compressor with a dual discharging switching mechanism.
Figure 8A:
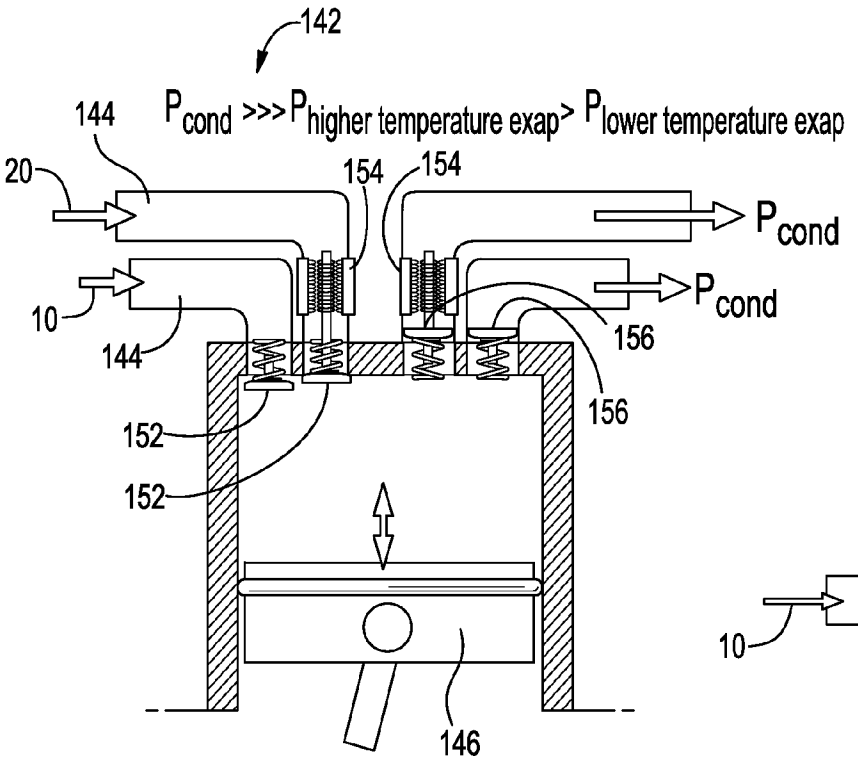
FIG. 8*a* is a schematic view of a dual suction-dual discharge compressor.

Similar systems as used in connection with the suction side of the compressor may also be used in connection with the discharge side of the compressor. The compressor may be a dual suction-dual discharge compressor (FIG. 8*a*). As shown in FIG. 8*a*, the compressor may include two intakes 144 and two outlet valves 156. Alternatively, as shown in FIG. 8*b*, a switching mechanism may be used on the discharge side of the compressor and positioned within or outside the housing of the compressor. The switching mechanism may use a magnetic actuated obstruction or, more typically one or more solenoid valves 164 to regulate the outgoing flow of coolant fluid to the compressor coils.

As shown in FIG. 10, the system using a dual discharge compressor may be combined with the use of a dual suction aspect to the compressor to provide the dynamic adjustability to make the system as efficient as possible by taking advantage of the concepts of dual suction efficiency discussed above and the concepts of dual discharge and rapid switching also discussed above. Conceivably, the compressor may have multiple suction ports and multiple discharge ports. More than two of each could be employed to create still further efficiencies and flexibility in humidity adjustment as discussed herein.

The systems with dual discharge may use the staged condenser coils to provide heating to a household appliance. For example, the condensers might be thermally associated with a water heater or a drying chamber.

FIGS. 11*a*, 11*b*, 12*a*, 12*b* show two embodiments that show a thermally disjointed evaporator system with the lower temperature and higher temperature evaporators working together to regulate sensible and latent heat but where there is either a thermal break (FIGS. 11*a*, 11*b*) or physical separation (FIGS. 12*a*, 12*b*) between the lower temperature evaporator 127 and the higher temperature evaporator 126.

Figure 11A:
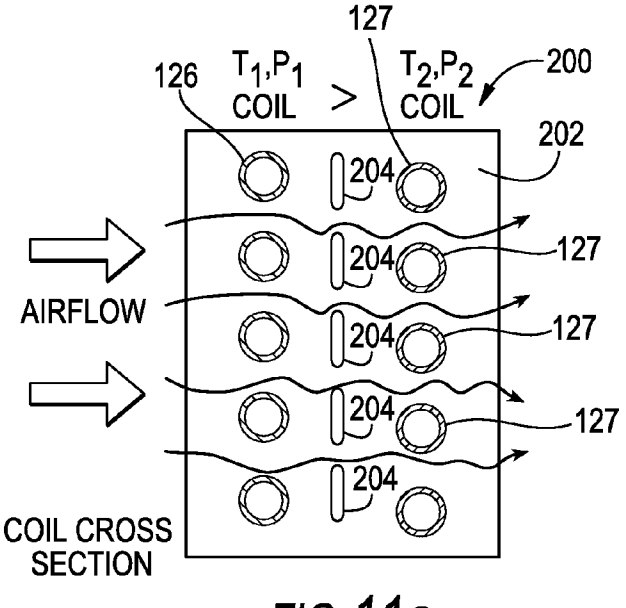
FIG. 11*a* is a top schematic view of an evaporator system according to an aspect of the present invention employing evaporator coils operating at different temperatures and interconnected with common fins.
Figure 11B:
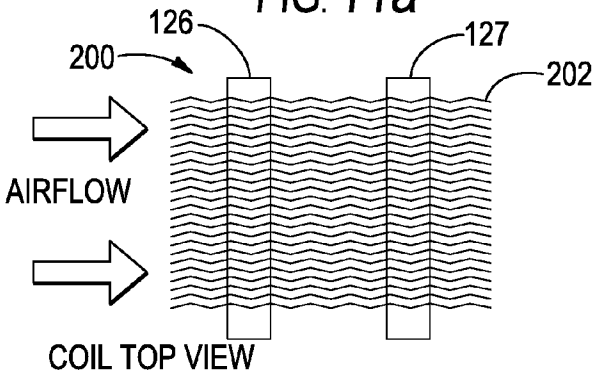
FIG. 11*b* is an elevated schematic side view of the evaporator of FIG. 11*a;*

FIGS. 11*a* and 11*b* show a disjointed evaporator system 200 that employs the lower temperature evaporator 127 and the higher temperature evaporator 126 in a manner that they share common fins 202. The common fins have at least one and more typically a plurality of thermal break portions 204 at a distance from the evaporator tubes to elongate and interrupt the conductive heat flow path. The lower temperature evaporator 127 and higher temperature evaporator 126 have a plurality of conduit loops and are parallel with one another. The evaporator coils generally define a first temperature zone of the evaporator system and a second temperature zone of the evaporator system. The zones are generally separated by the thermal break portions 204 that are positioned generally down the center of the evaporator system between the lower temperature evaporator coil section and the higher temperature evaporator coil section of the evaporator system, which are generally each a half of the overall evaporator system.

Figure 12A:
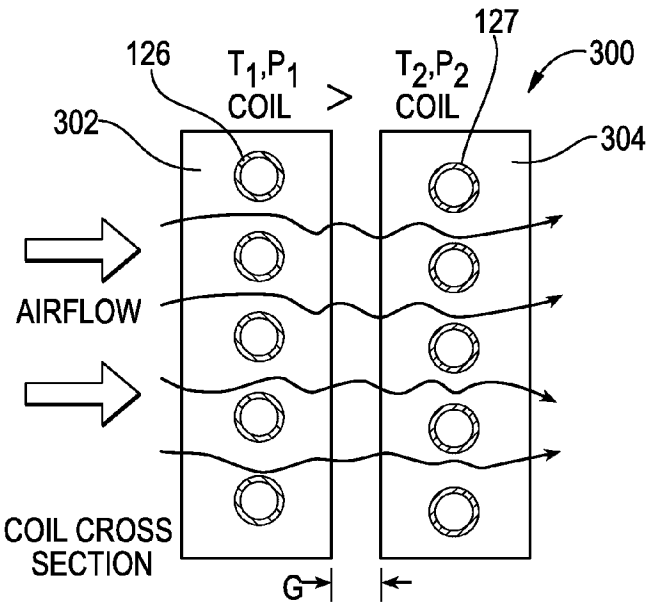
FIG. 12*a* is a top schematic view of an evaporator system according to an aspect of the present invention employing evaporator coils operating at different temperatures that are disconnected by having fins of one evaporator constructed and aligned to feed airflow into the fins of the lower temperature evaporator.
Figure 12B:
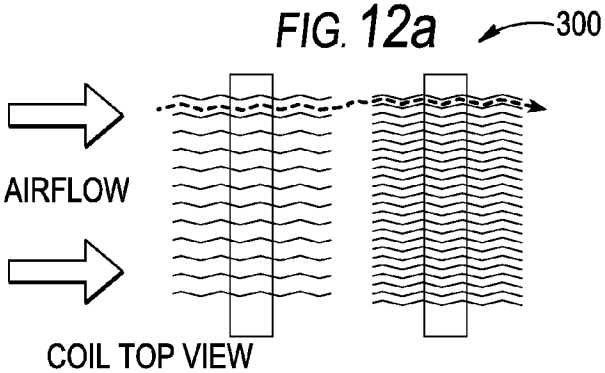
FIG. 12*b* is an elevated schematic side view of the evaporator of FIG. 12*a;*

FIGS. 12*a*, and 12*b* show an alternative disjointed evaporator system that align and position fins 302 and fins 304 relative to one another such that the spacing of the fins that are engaged with the higher temperature evaporator 126 are spaced apart to facilitate the shedding of the condensate off the fins for optimal heat transfer. The spaced apart fins (less than 22 fins per inch, more likely about 14 to about 18 fins per inch) are typically designed to feed the air flow into the space between fins 304 that are operably connected to the lower temperature evaporator, which predominately regulates sensible cooling, but do some dehumidification as well. This construction helps facilitate condensate shedding and the transfer of latent heat and overall heat transfer. The downstream fins 304 have greater fins per inch of evaporator coil than the upstream fins to facilitate heat transfer with the airflow through the fins, for example, the fins might be present in an amount of greater than 22 fins per inch, i.e. 25 fins per inch or more. The lower temperature evaporator 127 and fins 304 would be primarily responsible for mostly sensible cooling and some latent cooling in the system. The higher temperature evaporator 126 and fins 302 would be primarily responsible for most of the latent heat cooling and some sensible cooling. Both evaporators will regulate latent and sensible heat to some degree. These evaporator systems would most typically be employed when the lower temperature and higher temperature evaporators are spaced proximate to one another such as in the embodiment of the present invention depicted schematically in FIG. 2. Such configurations with greater spaced apart fins could be used in other embodiments with the evaporators are not proximate one another. For example, in the context of FIG. 3, the evaporator system could be used and the evaporators would not be arranged relative to one another and the airflow path to have the airflow over the fins 302 feed between the fins 304, but the more compact nature of the fins 304 would enhance the sensible heat energy transfer and the more spaced fins 302 would facilitate the initial latent heat energy transfer and subsequent condensate drainage.

Figure 1:
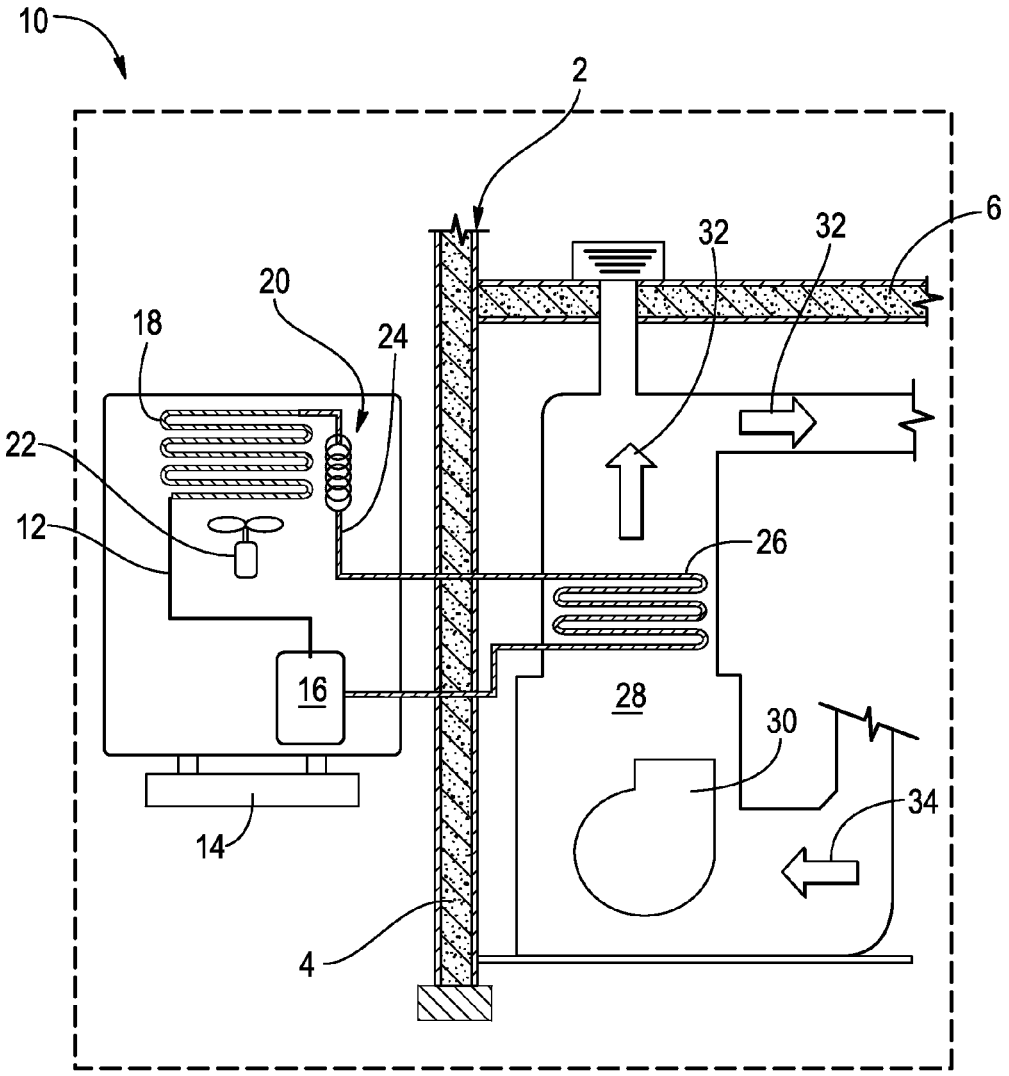
FIG. 1 PRIOR ART
FIG. 1 is a schematic view of traditional air conditioning system employing a single evaporator operating at a single evaporating pressure and a single inlet and single outlet compressor.
Figure 13:
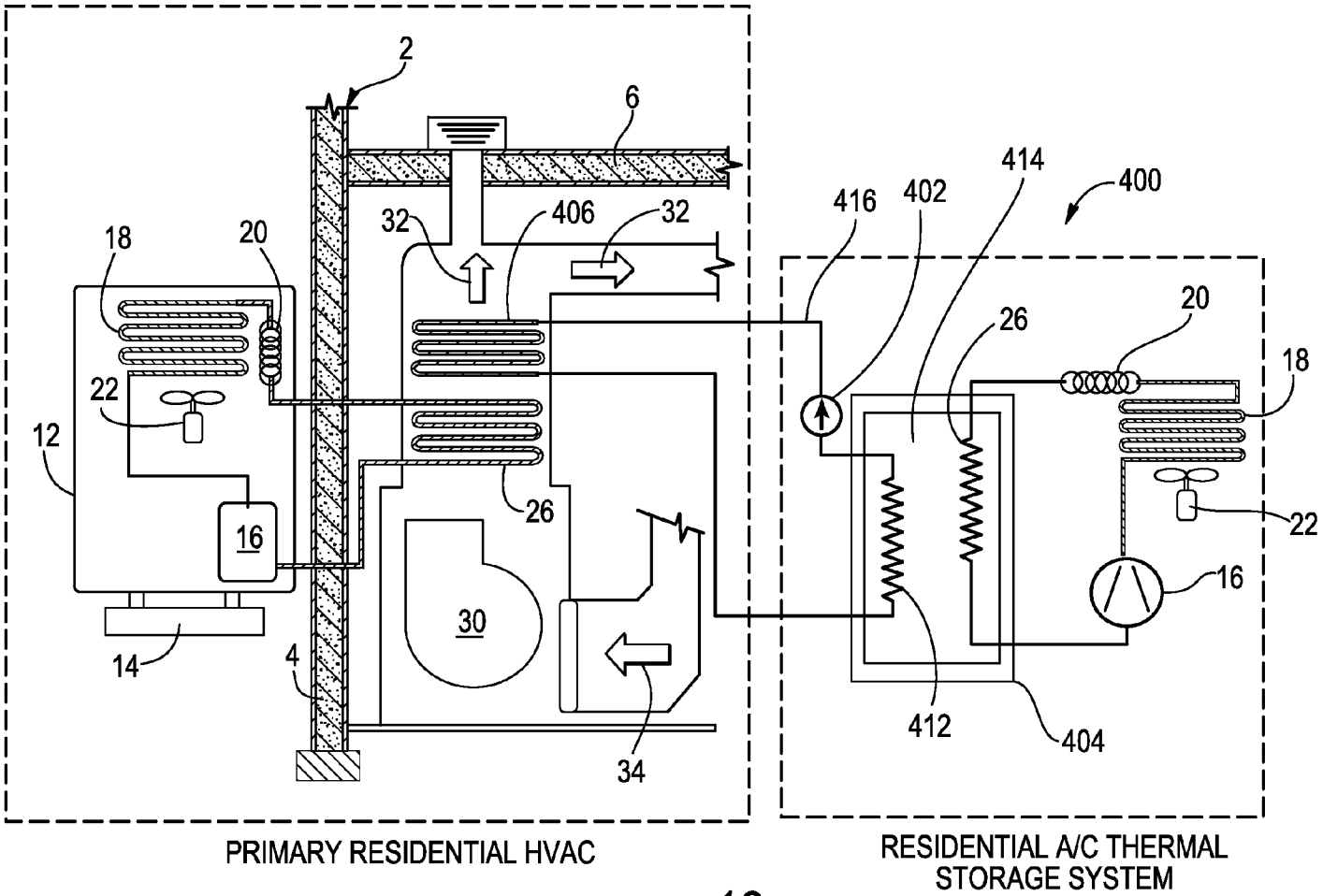
FIG. 13 is a schematic view of another aspect of the present invention showing a retrofitted air conditioning thermal storage system.
Figure 14:
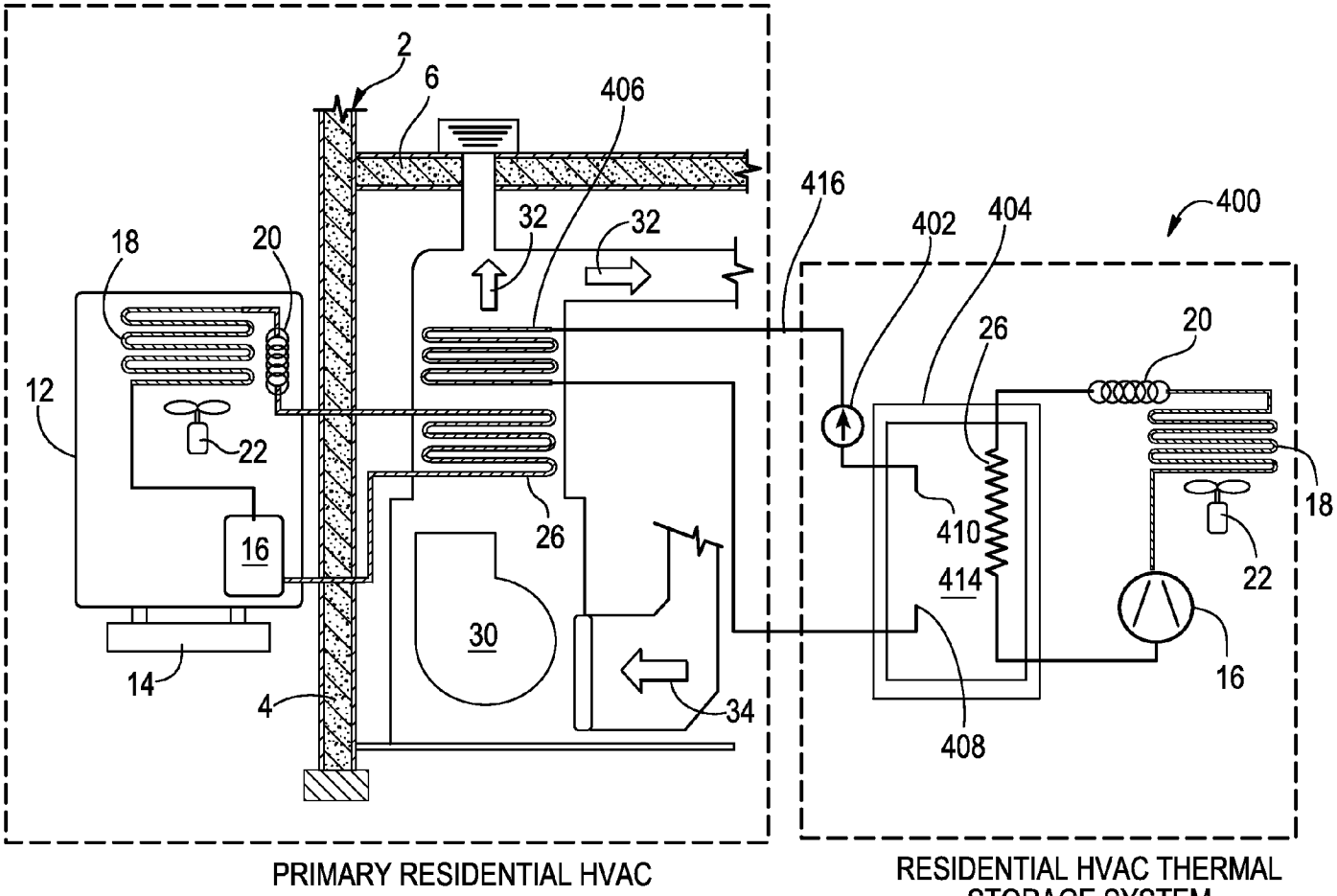
FIG. 14 is a schematic view of another aspect of the present invention showing a retrofitted air conditioning thermal storage system.

FIGS. 13 and 14 show a retrofittable air conditioning system thermal storage system 400. The retrofittable thermal storage system by be employed with the air conditioning systems of the present invention or traditional air conditioning systems. FIGS. 13 and 14 show the retrofittable thermal storage system 400 installed in connection with a traditional air conditioning system such as that shown in FIG. 1.

The retrofittable thermal storage system 400 is installed to store thermal cooling capacity in an air conditioning system for use during peak usage times when the building structure's main cooling system is offline or its use curtailed or otherwise minimized. A pump 402, which may be positioned before or after the thermal energy storage fluid tank 404 along the coolant loop 416. While shown schematically as pumping coolant fluid in a counterclockwise direction, the directional flow from the pump 402 could be in either direction so long as coolant is in thermal communication/contact the thermal energy storage fluid tank 404 and into the airflow path to be cooled by the heat exchanger 406. In the aspect of the invention shown in FIG. 13, a heat exchanger 412 is positioned in the thermal energy storage fluid tank 404 and operably connected to the coolant fluid lines of the coolant loop 416. The thermal energy storage fluid tank 404 is cooled, typically during off peak times, by a refrigeration system employing a traditional compressor 16, condenser 18, thermal expansion device 20, fan 22, and evaporator 26. The evaporator 26 of the retrofittable thermal storage system 400 is spaced within or otherwise in thermal communication with the thermal energy storage material (fluid) 414 within the thermal energy thermal storage fluid tank 404. In the embodiment show in FIG. 14, the heat exchanger 412 is omitted and the thermal energy storage fluid within the thermal energy thermal storage fluid tank 404 itself operates at the heat exchanger/coolant fluid. Coolant fluid in this instance is the thermal energy storage fluid and is received into the tank through outlet 408 and returns to the coolant loop 416 through inlet 410.

Figure 15:
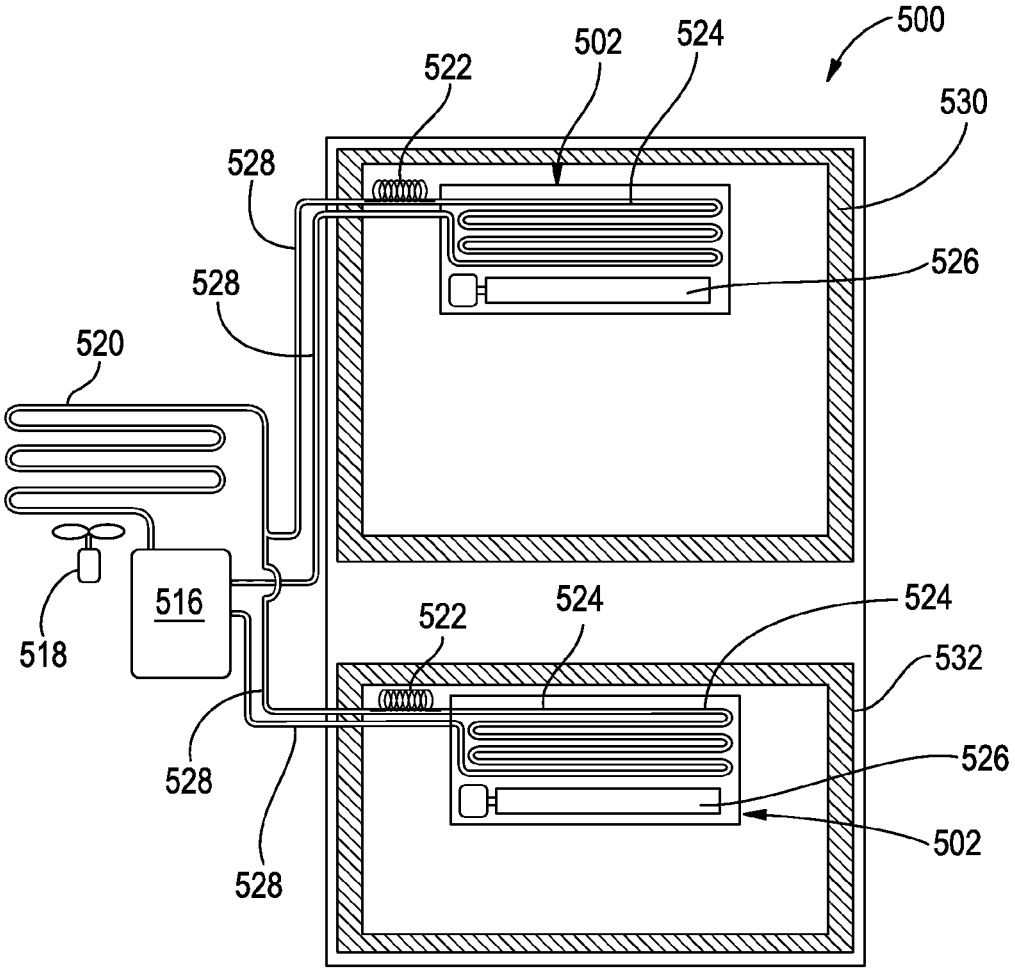
FIG. 15 is a schematic view of a split air conditioning system according to another aspect of the present invention.

As shown in FIG. 15, in another embodiment of the present invention, a split air conditioning system 500 may be utilized to drive a plurality of indoor air units 502. (FIG. 15 shows two indoor air units but multiple indoor air units can be employed and one or more air units may be positioned in various rooms within a building structure.) Each individual indoor air unit 502 can be turned on or off in a given space. The split indoor air conditioning system 500, as shown in FIG. 15, utilizes the dual suction (multi-suction) compressor concepts described herein to provide greater benefits. Switching the suction valves to feed the evaporators of the various air conditioning units in the interior of the home equally or to provide warmer or cooler evaporator temperatures for the respective rooms is possible using this system. The warmer temperature evaporator would cool the air less but still provide a level of dehumidification. The cooler evaporator could be utilized to chill air more but also dry the air more. The cooling capacity and, thus, the temperature of an evaporator at which it functions is based upon the expansion device but also the flow rate of refrigerant and the suction pressure the evaporator sees from the compressor. If the indoor units are identical with identical expansion device resistance, then the multi-suction valve systems of the present invention can drive either evaporator to a lower or higher pressure relative to the other evaporator(s). Certain ways to accomplish this include: managing the opening and closing of the compressor suction valve(s) or adjusting the timing of valve opening and compressor piston or vane stroke position to achieve the desired pressure level range. In the example shown in FIG. 15, the upper section might be a living room which is kept cool and dry and driven by a lower temperature evaporator (50° F.). This will provide more cooling capacity (refrigerant flow at lower evaporator pressure) by biasing the duty cycle of the suction port accordingly. The cycle on/off for use of a variable capacity compressor and fan may be utilized to slow the rate of cooling and achieve a slight rise in temperature (55° F.).

The lower section of FIG. 15 might be a bedroom that is kept more cool and moist for optimum comfort (a higher temperature evaporator of about 60° F., for example). This system would provide higher suction pressure and less cooling capacity by biasing the duty cycle of the suction port accordingly.

Figure 16:
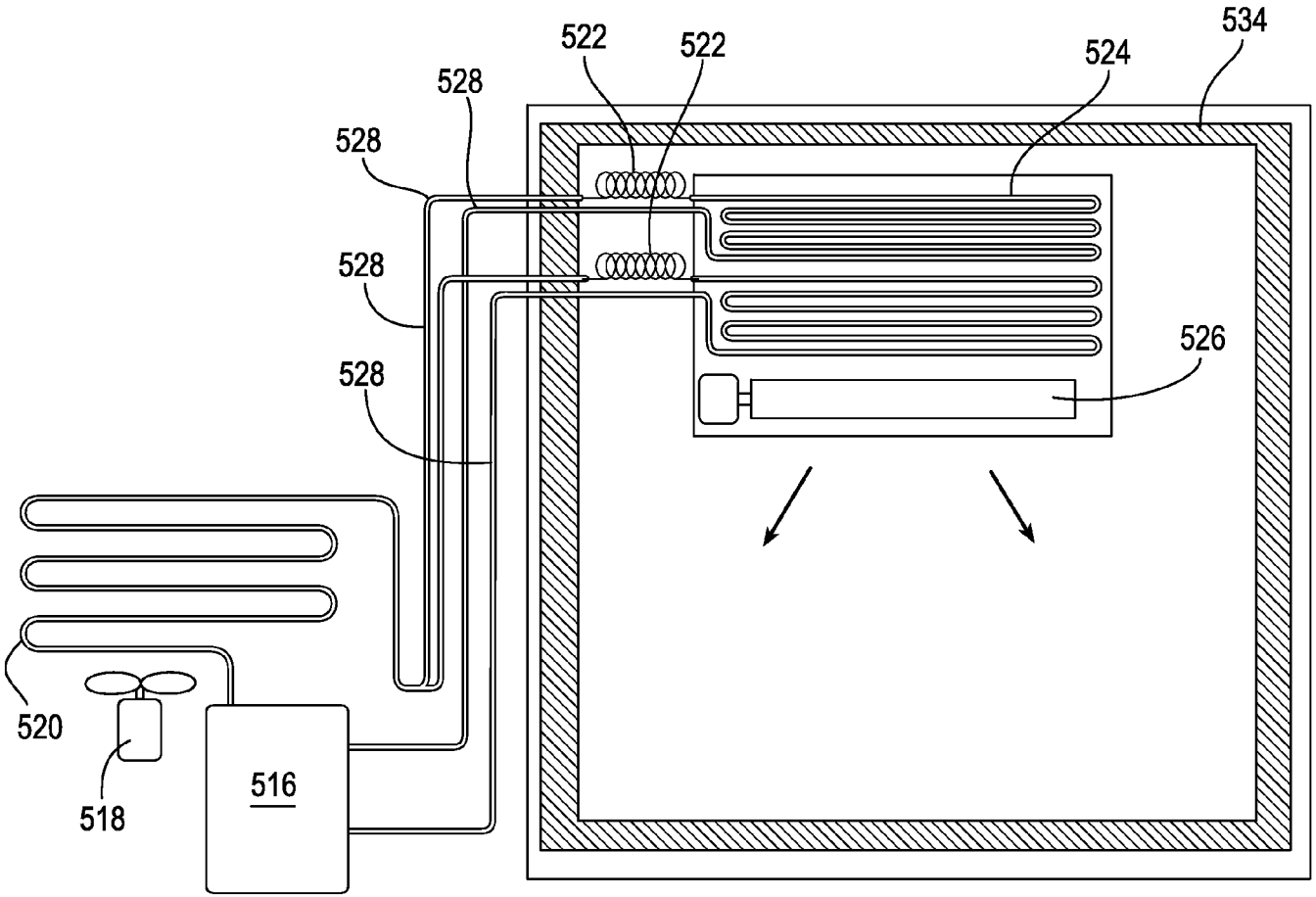
FIG. 16 is another schematic view of a single outdoor air conditioning system according to another aspect of the present invention.

The system shown in FIG. 16 shows a single outdoor unit driving a single (potentially multiple) indoor unit(s) in a split system air conditioner with dual (multi) suction and a two-section coil evaporator. Switching the suction valving in this embodiment provide more or less chilled air temperatures and more or less humidity in a given conditioned living space. The warmer temperature evaporator would cool the air less but still provide a level of dehumidification. A cooler evaporator would chill the air more but dry the air more. In combination, the air can be cooled and dehumidified to the desired level at an increased effective COP. The cooling capacity and the temperature an evaporator runs at is a function of the expansion device restriction, but also the flow rate of the refrigerant and the suction pressure of the evaporator as discussed above. It is this dynamic in the multi-suction systems of the present invention that enables the functionality described above.

FIG. 15 shows the compressor, which is typically a multi-suction compressor 516, a fan 518, a condenser 520, expansion devices 522, evaporators 524, and cross-flow fans 526 all fluidly connected by coolant fluid conduits 528. The evaporators 524 are each individually spaced in separate building structure cooling zones or rooms, 530 and 532 in FIG. 15. FIG. 16 shows a similar system, but the two evaporators, as discussed above, are in the same unit and used to condition the space within a single zone or room of a structure 534.

Those skilled in the art will recognize, or be able to ascertain using no more than routine experimentation, many equivalents to the specific embodiments of the invention described herein. Such equivalents are intended to be encompassed by the following claims.

The invention claimed is:

1. An evaporator system comprising:

a first evaporator coil at a first evaporator temperature and pressure;

a second evaporator coil at a second evaporator temperature and pressure that is less than the first evaporator temperature and pressure;

wherein the first evaporator coil and second evaporator coil are configured to be thermally disjointed; and a plurality of thermally conductive spaced apart evaporator fins, each fin having a plurality of spaced apart thermal break portions disposed on the fin positioned between the first evaporator coil and the second evaporator coil that thermally disjoin the first evaporator and coil the second evaporator coil.

2. The evaporator system of claim 1, wherein the first evaporator coil comprises a first evaporator refrigerant fluid conduit and the second evaporator coil comprises a second evaporator refrigerant fluid conduit that are each constructed into a plurality of conduit loops and wherein the plurality of conduit loops of the first evaporator refrigerant fluid conduit and the second evaporator refrigerant conduit are parallel with one another.

3. The evaporator system of claim 2, wherein at least one coil row of the first evaporator coil physically passes through the plurality of evaporator fins and the plurality of thermally conductive spaced apart evaporator fins are each the same.

4. The evaporator system of claim 1, wherein the first evaporator coil and the second evaporator coil each pass through the evaporator fins in a manner such that one zone of the fins are generally at a higher temperature than a second zone of the fins.

5. The evaporator system of claim 1 further comprising a plurality of thermal conductive path interruption portions that form a thermal break in the fins of the evaporator system.

6. The evaporator system of claim 5, wherein the evaporator fins are evenly spaced with one another and extend beyond the evaporator coil rows on all sides.

7. The evaporator system of claim 5, wherein the evaporator fins are evenly spaced with one another.

8. The evaporator system of claim 2, wherein the first evaporator coil and the second evaporator coil are operably connected to a compressor system having two suction lines.

9. The evaporator system of claim 8, wherein the compressor system having two suction lines comprises a compressor with a single suction port and a switching mechanism that includes a first refrigerant fluid intake that receives refrigerant fluid from the first evaporator coil and a second refrigerant fluid intake that receives refrigerant fluid from the second evaporator coil and an outlet that switches suction between the first refrigerant fluid intake and the second refrigerant fluid intake to deliver refrigerant to the compressor.

10. The evaporator system of claim 8, wherein the compressor system is a dual suction compressor having two suction ports where one suction port is operably and refrigerant fluidly connected with the first evaporator coil and another suction port is operably and refrigerant fluidly connected with the second evaporator coil.

11. The evaporator system of claim 1, wherein the evaporator system is operably connected as the evaporator of a forced air cooling vapor compression system for providing cooling to an interior volume of a building structure and wherein the first evaporator coil operates to remove more latent heat than the second evaporator coil and the second evaporator coil operates to remove more sensible heat than the first evaporator coil.

12. An evaporator system comprising:

a first evaporator coil at a first evaporator temperature and pressure;

a second evaporator coil at a second evaporator temperature and pressure that is less than the first evaporator temperature and pressure;

wherein the first evaporator coil and the second evaporator coil are operably connected to a compressor system having two suction lines;

wherein the compressor system having two suction lines comprises a compressor with a single suction port and a switching mechanism that includes a first refrigerant fluid intake that receives refrigerant fluid from the first evaporator coil and a second refrigerant fluid intake that receives refrigerant fluid from the second evaporator coil and an outlet that switches suction between the first refrigerant fluid intake and the second refrigerant fluid intake to deliver refrigerant fluid to the compressor;

wherein the first evaporator coil and the second evaporator coil are configured to be thermally disjointed wherein the first evaporator coil and the second evaporator coil are disjointed by a configuration chosen from the group consisting of:

a plurality of thermally conductive spaced apart evaporator fins, each fin having a plurality of spaced apart thermal break portions disposed on the fin positioned between the first evaporator coil and the second evaporator coil that thermally disjoin the first evaporator coil and the second evaporator coil; and a first set of evaporator fins thermally connected with the first evaporator coil and a second set of evaporator fins, physically separated from the first set of evaporator fins, the second set of evaporator fins thermally connected with the second evaporator coil wherein the first set of evaporator fins comprises individual fins spaced apart at a greater distance from one another than fins of the second set of evaporator fins.

13. The evaporator system of claim 12, wherein the second set of evaporator fins have a fin density of 20 fins per inch or greater and the first set of evaporator fins have a fin density of less than 20 fins per inch.

14. The evaporator system of claim 13, wherein the compressor system is a dual suction compressor having two suction ports where one suction port is operably and refrigerant fluidly connected with the first evaporator coil and another suction port is operably and refrigerant fluidly connected with the second evaporator coil.

15. The evaporator system of claim 12, wherein the evaporator system is operably connected as the evaporator of a forced air cooling vapor compression system for providing cooling to an interior volume of a building structure and wherein the first evaporator coil operates to remove more latent heat than the second evaporator coil and the second evaporator coil operates to remove more sensible heat than the first evaporator coil.

16. The evaporator system of claim 12, wherein the second set of evaporator fins have a fin density of 22 fins per inch or greater and the first set of evaporator fins have a fin density of less than 18 fins per inch.

17. An evaporator system comprising:

a first evaporator coil at a first evaporator temperature and pressure;

a second evaporator coil at a second evaporator temperature and pressure that is less than the first evaporator temperature and pressure;

wherein the first evaporator coil and the second evaporator coil are operably connected to a compressor system having two suction lines;

wherein the compressor system having two suction lines comprises a compressor with a single suction port and a switching mechanism that includes a first refrigerant fluid intake that receives refrigerant fluid from the first evaporator coil and a second refrigerant fluid intake that receives refrigerant fluid from the second evaporator coil and an outlet that switches suction between the first refrigerant fluid intake and the second refrigerant fluid intake to deliver refrigerant fluid to the compressor;

wherein the first evaporator coil and second evaporator coil are configured to be thermally disjointed; and a first set of evaporator fins thermally connected with the first evaporator coil and a second set of evaporator fins, physically separated from the first set of evaporator fins, the second set of evaporator fins thermally connected with the second evaporator coil wherein the first set of evaporator fins comprises individual fins spaced apart at a greater distance from one another than fins of the second set of evaporator fins.

18. The evaporator system of claim 17, wherein the second set of evaporator fins have a fin density of 20 fins per inch or greater and the first set of evaporator fins have a fin density of less than 20 fins per inch and are configured to allow the first evaporator coil and fins to remove more latent heat than the second evaporator coil and fins and the second evaporator coil and fins to remove more sensible heat than the first evaporator coil and fins.

* * * * *